US006385899B1

(12) United States Patent
Treganza

(10) Patent No.: US 6,385,899 B1
(45) Date of Patent: May 14, 2002

(54) DECORATIVE PLANT STAND WITH INTEGRATED DRAINAGE AND ROTATION FEATURES

(76) Inventor: Sachiko Mary Treganza, 5066 Pine Tree Ter., Campbell, CA (US) 95008

( * ) Notice: Subject to any disclaimer, the term of this patent is extended or adjusted under 35 U.S.C. 154(b) by 0 days.

(21) Appl. No.: 08/275,607

(22) Filed: Jul. 15, 1994

(51) Int. Cl.[7] ..... A47G 7/04; A01G 9/02
(52) U.S. Cl. ..... 47/39; 47/39; 47/66.6
(58) Field of Search ..... 47/39 P, 41.14, 47/41.1

(56) References Cited

U.S. PATENT DOCUMENTS

| | | | | | |
|---|---|---|---|---|---|
| 183,153 | A | * | 10/1876 | Hegarty | 47/39 |
| D23,906 | S | * | 12/1894 | Symonds | 47/39 |
| 540,681 | A | * | 6/1895 | Myers | 47/39 |
| 587,404 | A | * | 8/1897 | Schoyen | 47/39 P |
| 1,190,147 | A | * | 7/1916 | Gloede | 47/39 |
| 1,451,515 | A | * | 4/1923 | Niemczewski | 47/39 |
| 1,487,231 | A | * | 3/1924 | George | 47/39 P |
| 2,003,986 | A | * | 6/1935 | Witthuhn | 47/39 P |
| 3,451,622 | A | * | 6/1969 | Forney | 47/39 |
| 4,006,559 | A | | 2/1977 | Carlyon, Jr. | 47/39 |
| 4,018,004 | A | | 4/1977 | Soffer | 47/39 |
| 4,020,592 | A | | 5/1977 | Saunders | 47/71 |
| 4,023,305 | A | | 5/1977 | Harschel | 47/81 |
| 4,026,067 | A | | 5/1977 | Wengel | 47/39 |
| 4,062,147 | A | | 12/1977 | Phillips | 47/71 |
| 4,102,081 | A | | 7/1978 | Morrow | 47/67 |
| 4,109,415 | A | | 8/1978 | Hall | 47/67 |
| 4,125,965 | A | | 11/1978 | Schweim | 47/39 |
| 4,143,487 | A | | 3/1979 | Hollwarth | 47/59 |
| 4,167,080 | A | | 9/1979 | Mickelson | 47/71 |
| D254,127 | S | | 2/1980 | Sgroi | D11/153 |
| 4,205,485 | A | | 6/1980 | Olsen | 47/77 |
| 4,244,147 | A | | 1/1981 | Geddes | 47/39 |
| 4,250,665 | A | | 2/1981 | English et al. | 47/81 |
| 4,250,666 | A | | 2/1981 | Rakestraw | 47/83 |
| 4,276,720 | A | | 7/1981 | Lyon | 47/39 |
| 4,349,864 | A | | 9/1982 | Smith | 362/122 |
| 4,571,883 | A | | 2/1986 | Shaw | 47/66 |
| 4,635,394 | A | | 1/1987 | Brown | 47/67 |
| 4,739,581 | A | | 4/1988 | Jarvis | 47/66 |
| 4,771,573 | A | | 9/1988 | Stengel | 47/67 |
| 4,829,708 | A | | 5/1989 | Gonzalez | 47/39 |
| 4,829,709 | A | | 5/1989 | Centafanti | 47/79 |
| 4,927,106 | A | | 5/1990 | Tomforde et al. | 248/146 |
| 5,052,149 | A | | 10/1991 | Johnson | 47/67 |
| 5,062,239 | A | * | 11/1991 | Helton | 47/67 |
| 5,094,031 | A | | 3/1992 | Lee | 47/66 |
| 5,125,184 | A | | 6/1992 | Anderson | 47/81 |
| 5,199,213 | A | | 4/1993 | Krebs et al. | 47/39 |
| 5,209,013 | A | | 5/1993 | Sellers | 47/71 |
| 5,224,293 | A | | 7/1993 | Sarb | 47/66 |
| 5,241,781 | A | * | 9/1993 | Malczyk | 47/39 |
| 5,299,384 | A | | 4/1994 | Andrews | 47/66 |
| 5,347,751 | A | * | 9/1994 | Cavpay | 47/39 |

FOREIGN PATENT DOCUMENTS

| | | | | |
|---|---|---|---|---|
| DE | 3632371 | * | 3/1988 | 47/39 |

* cited by examiner

*Primary Examiner*—Charles T. Jordan
*Assistant Examiner*—Son T. Nguyen
(74) *Attorney, Agent, or Firm*—Fliesler Dubb Meyer & Lovejoy LLP; Gideon Gimlan

(57) ABSTRACT

A decorative plant stand is disclosed with integrated drainage and rotation features. A decorative exterior finish of the stands hides an interior support frame and drainage water collecting and storing subsystems. Wheels or other rotation means are hidden under a base portion of the stand for allowing the stand to be rotated for uniform lighting and ventilation. A shut-off valve is provided within the drainage water collecting subsystem so that the drainage water storing subsystem can be conveniently emptied without spillage.

38 Claims, 2 Drawing Sheets

DECORATIVE PLANT STAND WITH INTEGRATED DRAINAGE AND ROTATION FEATURES

FIELD OF THE INVENTION

The invention is generally directed to potted plants. The invention is more specifically directed to a system for supporting an indoor potted plant, for continuously supplying fresh water to the soil and root structure of the plant, for continuously draining away old water, and for supplying uniform lighting and ventilation to the plant.

BACKGROUND OF THE INVENTION

Potted plants are routinely found in indoor environments such as the home or office. The plants are used to decorate the indoor environment and to provide a natural ambiance.

A plant-decorated home or office will typically have an average of at least one plant per room but it is also common to find indoor environments having a plurality of potted plants in each room.

Potted plants come in a wide variety of sizes, types and shapes ranging from small ones (e.g., Indian cress) to large leafy ones (e.g., ferns, golden pathos, spider plant, philodendron, wandering jew, chlorophytum) and even to miniature indoor trees. The size of the pot can range from just a few inches in diameter and height to a few feet in one or both dimensions.

The plant can have a branch and leaf structure that spreads out to dimensions much larger than that of its holding pot, thereby making the combination of plant and pot rather large and bulky.

The larger sized combinations of plant, wet soil and pot can weigh as much as 30 to 50 pounds, or 100 pounds, or even more.

The care of indoor plants, including routine watering, ventilation, and lighting, presents a problem, particularly where heavy and/or bulky combinations of plant, soil and pot are concerned.

Adequate watering and good drainage are important. Each plant should receive at least its minimum daily requirement (or other periodic requirement) of water and other nourishments (e.g., fertilizers, pesticides, etc.). However over watering to the point of saturating the soil should be avoided. The soil and root system of a potted plant are generally confined to the boundaries of the pot, and as such, it is advisable to make sure that the pot soil does not become saturated with standing water. Prolonged immersion of the plant root system in standing water can lead to root rot and other problems. The plant's root system and the soil should be periodically irrigated with clean, fresh water and the older water should be drained away.

Good lighting and ventilation are also important. It is desirable to provide uniform lighting and ventilation to the plant leaf structure so that the plant develops symmetrically. Non-uniform lighting or ventilation can lead to asymmetric growth, which is aesthetically unpleasing.

The major reason for having indoor plants in the first place, is to aesthetically decorate the indoor environment. Accordingly, it is important to aesthetically integrate the potted plant and its support systems (irrigation, ventilation, lighting, positioning, etc.) with the surrounding indoor environment.

Aesthetic integration may present a problem, particularly where the larger-sized plants in the 10-to-50 pound and over dry-weight class are concerned. (The 10–50 pound-plus dry weight class is defined here as any combination of plant, dry soil and pot that weighs approximately 10 pounds or more. A nominal range is approximately 30 to 50 pounds dry weight, but larger dry weights are also contemplated.) Such large-sized plants require a sturdy positioning means for positioning them at a desired position within a room. The large-sized plants tend to require greater quantities of daily watering and lighting than do smaller plants. It can become difficult to meet the physical needs of a large-size plant and to at the same time integrate the potted plant and its support systems (irrigation, ventilation, lighting, positioning, etc.) naturally and aesthetically with the surrounding indoor environment.

There have been numerous, but unfortunately partial, attempts to solve the problems discussed above.

The most common technique used for indoor plants is to place the pot on a drainage tray and to provide a drainage hole at the bottom of the pot through which excess water drains for collection by and storage in the drainage tray. The drainage tray is placed directly on the floor or on a sturdy table.

The drainage tray is generally the same width or slightly wider than the pot but much smaller in height. Hence, the water-storing volume of the drainage tray is substantially less than that of the pot; and there is a danger that the tray will flood over if too much water is poured into the pot. There is generally no separation between the pot and the tray to prevent old water from leaching back into the pot soil. Undesirable root rot can develop if a high level of standing water is left in the drainage tray for long periods of time. As a result of these dangers, users tend to under-water their plants rather than to risk over-flooding the drainage tray and ruining the floor or furniture or risk leaving too-high a level of standing water in the tray. As a result, plants do not always get sufficient water for healthy growth.

An example of the drainage tray approach is seen in U.S. Pat. No. 4,739,581, issued Apr. 26, 1988 to Jarvis and entitled FLOWER POT. Another example is seen in U.S. Pat. No. 4,062,147, issued Dec. 13, 1977 to Phillips and entitled HORTICULTURAL CONTAINER ASSEMBLY WITH SAUCER DRAINAGE AND VENTILATION PASSAGE.

Another approach is to hang the potted plant from an overhead support and provide means for periodic watering and drainage. One example of such an approach is seen in U.S. Pat. No. 5,052,149, issued Oct. 1, 1991 to Johnson and entitled PORTABLE APPARATUS FOR CAPTURING OVERFLOW FROM HANDING PLANTS. Another example is seen in U.S. Pat. No. 5,062,239, issued Nov. 5, 1991 to Helton and entitled METHOD AND APPARATUS FOR WATERING POTTED PLANTS. The overhead suspension approach is generally limited to combinations of plant, pot and soil in the low-weight class (less than 10 pounds dry weight).

There have been attempts to aesthetically integrate the drainage tray with the surrounding environment. One interesting approach is taken in U.S. Design Pat. No. 254,127, issued Feb. 5, 1980 to Sgroi and entitled COMBINED FLOWER POT TRAY, AND WATERING RESERVOIRS. An outer shell assembly combines with a bottom drainage tray to provide a decorative cover for a flower pot.

The above-mentioned previous approaches each make a stab at solving one or another of the problems associated with the care and enjoyment of indoor potted plants, but none provides an integrated solution for easily maintaining an indoor potted plant while aesthetically integrating the plant and its support systems (irrigation, ventilation, lighting, positioning, etc.) in a complementary fashion with indoor decor.

SUMMARY OF THE INVENTION

In accordance with the invention, there is provided a symmetrical and decorative apparatus that supports a potted plant and non-conspicuously houses a water drainage subsystem for the potted plant. Movement means are provided for non-conspicuously rotating the potted plant so that the plant receives uniform lighting and ventilation from all sides and for moving the plant to desired positions in a room. Valve and emptying means are provided so that any desired quantity of water may be passed through the root and soil system for purposes of nourishment or flushing out undesirable salts from the soil.

BRIEF DESCRIPTION OF THE DRAWINGS

The below detailed description makes reference to the accompanying drawings, in which.

DETAILED DESCRIPTION

Figure 1:
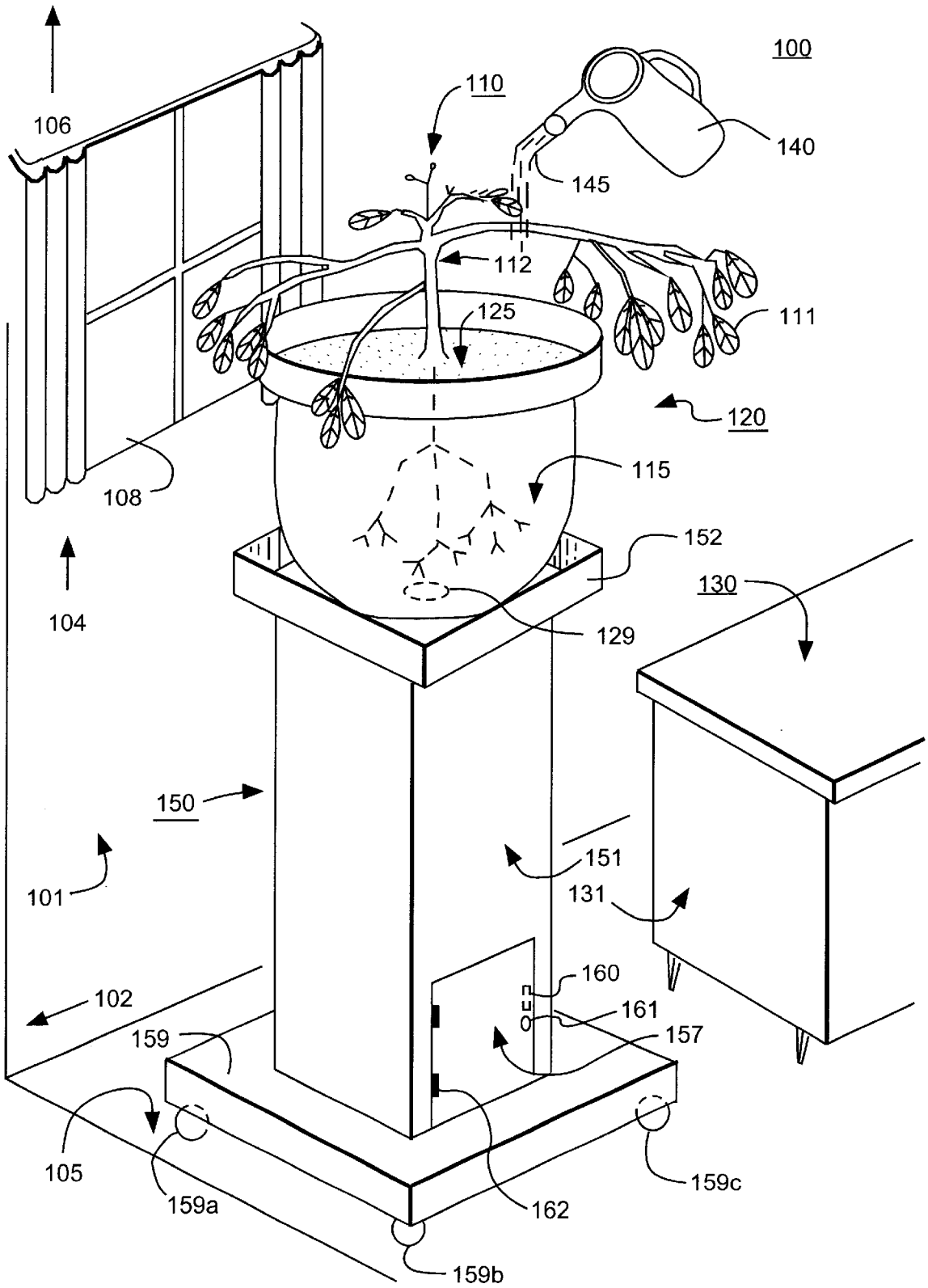
FIG. 1 is a perspective view of a plant stand in accordance with the invention, the view showing the stand aesthetically integrated within an indoor room environment.

Referring to FIG. 1, there is shown an indoor environment 100 in which a potted plant 110 is supported by a plant stand 150 of the invention.

The indoor environment 100 can be a room in a house or in an office or can be an interior part of any other building or structure. For purpose of simplicity, the indoor environment 100 will referred to as a "room" 100.

The illustrated room 100 includes one or more walls 101, 102 separating the plant 110 from an outdoor environment. The walls 101, 102 may be decorated with paint, wallpaper and/or wood paneling and may be further covered with drapery 104 or otherwise decorated as desired.

The room 100 further includes a floor 105 provided below the plant for supporting the weight of the plant 110. The floor 105 may be carpeted, and/or made of a decoratively stained and varnished hardwood, and/or tiled, and/or otherwise furnished in a decorative manner.

A ceiling 106 may be provided above the plant for covering the plant. The ceiling 106 may include electric light fixtures (e.g., chandeliers, fluorescent lights, etc., not shown) and air vents (not shown).

In addition to, or as an alternative to the lighting and/or ventilation made available from the ceiling 106, a window 108 or other opening may be provided in the room 100 for supplying outdoor sunlight and/or fresh air to the plant 110. As yet another addition or alternative, the room 100 may have a door or hallway (not shown) leading to an outdoor porch, patio, or the like.

The plant and its stand 150 may be positioned near the window 108 (e.g. within six feet) either on a temporary or permanent basis for supplying the plant 110 with outdoor lighting and fresh air. If there is a nearby outdoor porch or patio, it may be desirable to temporarily move the plant to the outdoor environment for sunlight and fresh air.

The room 100 typically includes additional furnishings or furniture 130 that are placed aesthetically in relation to the potted plant 110 and its supporting stand 150. The additional furnishings/furniture 130 can include one or more of a desk, a chair, a couch, a table, a credenza, an entertainment unit (e.g., stereo radio and television), a bookshelf/wall unit, and so forth.

An exterior surface 131 of the additional furnishings/furniture 130 may be decorated with a paint and/or with stained and varnished wood such as mahogany and/or it may be covered with a decorative fabric having a desired color and decorative pattern and/or it may be otherwise finished so as to have a desired coloration, pattern, and surface texture.

The exterior 151 of plant stand 150 is shaped and decorated to aesthetically blend with and complement or match the decor of the surrounding furnishings/furniture 130 and other portions (e.g. 101, 102, 104, 105, 108) of the room 100.

By way of example, if the exterior finish 131 of an adjacent piece of furniture 130 is a stained mahogany, the exterior finish 151 of plant stand 150 can be made to include a substantially similar, mahogany finish so that the stand exterior finish 151 matches the exterior finish 131 of the adjacent furniture 130 in color and/or texture.

By way of further example, if the adjacent furniture 130 is box-like in shape (e.g. it has generally rectangular features), the exterior 151 of stand 150 can be formed to have a matching, box-like shape that blends with or complements the shape of the adjoining furniture 130.

In the illustrated example, the adjoining furniture 130 is shown as a rectangular solid with a slab top and the outer surface 151 of stand 150 also appears as a rectangular solid. The top view of the illustrated stand 150 has a square (symmetrical) cross-section.

A base portion 159 of the illustrated plant stand 150 includes a plurality (e.g. four or more) of caster wheels 159*a*–159*d* for supporting the combination of the stand and potted plant on the floor 105 (which floor could be carpeted) and for allowing the combination stand/plant (150/110) to be easily pushed across the floor 105 and/or to be easily rotated about a current position so as to provide uniform lighting and ventilation to the potted plant 110. The wheels 159*a*–159*d* are preferably spaced sufficiently far apart from, and symmetrically about, the vertical axis of the stand 150 so as to provide stable support and so as to distribute the weight of the plant, wet soil, pot and remainder of the stand 150 uniformly among the plural wheels 159*a*–159*d*.

An access door 157 is provided near the bottom of the stand 150 for accessing an enclosed, water-drainage subsystem which will be described shortly.

A top tray portion 152 of the stand supports the potted plant 110, the plant pot 120 and the potting Boil 125. The top tray portion 152 of the stand includes a means for collecting drainage water from the plant pot 120 and for funneling the water to a drainage collection subsystem (not yet shown) enclosed within the stand 150.

The access door 157 preferably meshes non-conspicuously with the exterior finish 151 of the stand so that the door 157 is not easily seen without close inspection. The stand 150 as a whole should appear to be no more than another piece of furniture that matches the surrounding decor (e.g. furnishings/furniture 130) and merely supports the plant 110 and its pot 120. If desired, the access door 157 could be made to appear like the exterior of a slide-out draw so that the stand 150 appears to be a decorative cabinet with such a slide-out draw.

The plant 110 will typically include a leafy portion 111 extending outside the pot 120. In the case of large, droopy fauna such as ferns, the leafy portion 111 can droop downwardly from the top of the pot 120 to cover not only the pot exterior 121, but even an upper portion or more of the stand 150.

A plant stem 112 connects the leafy portion 111 to a root system 115 of the plant. The plant root system 115 extends into the pot soil 125. The plant root system 115 is illustrated as hidden, dashed lines.

Irrigation may be provided with a simple watering can 140, as shown, or with other more-intricate irrigation means, as desired. The irrigating water 145 flows through the potting soil 125 under the force of gravity from a top portion of the soil to a bottom portion, passing by the plant root system 115 in the process.

The amount of irrigating water 145 provided in each application will vary depending on the type and size of the plant 110 and the potting soil 125 and the purpose of the irrigation. In some situations it may be desirable to administer between a quart and a gallon of irrigating water 145 each time the plant is watered. On occasion, it may be desirable to flush out harmful salts or other chemicals that may have accumulated in the potting soil. In the latter situation, it may be desirable to pass many gallons of water through the soil 125 in relatively short time (e.g., in a single day) in order to wash undesired chemical accumulations out of the soil.

The top of the plant pot 120 is preferably held by the stand 150 at a height which not only integrates the plant 110 aesthetically into the remainder of the room 100 but also at a height (e.g., approximately 3 to 5 feet) which makes it easy for a standing person to hold the watering can 140 at a convenient height while irrigating. Of course, aesthetics may take precedence over watering convenience.

One or more drainage holes 129 are defined through the bottom of the pot 120 to allow irrigating water 145 to flow beyond the plant root system 115 and into the top tray portion 152 of the stand for collection. FIG. 1 shows one such drainage hole 129 of the pot as a dashed hidden circle.

Figure 2:
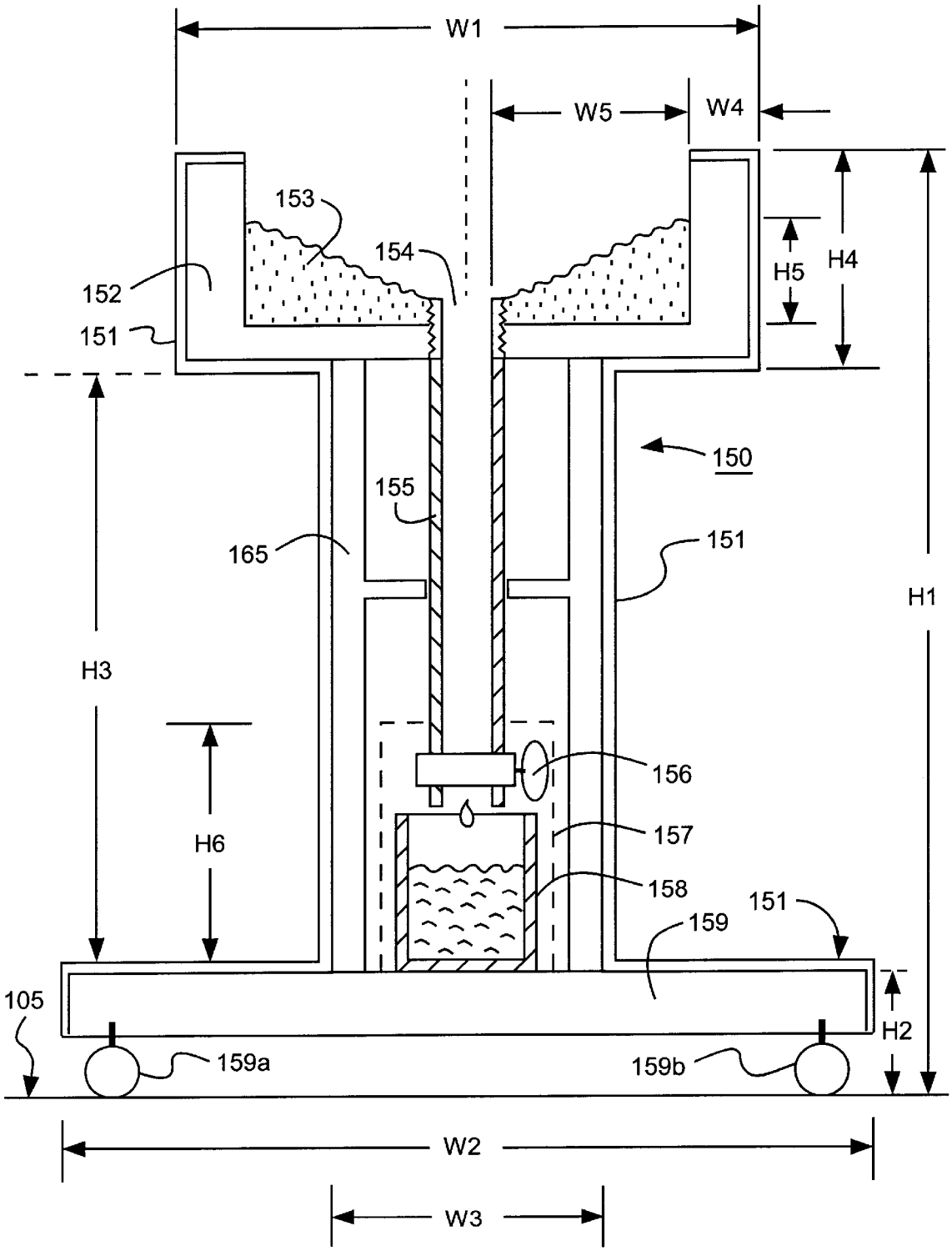
FIG. 2 is a cross-sectional view of the plant stand shown in FIG. 1.

Referring to the cross sectional view of FIG. 2, it can be seen that the top tray portion 152 is shaped to both support the plant, and its pot, and to function as a drainage collection tray for collecting drainage water from the plant 110 and its soil 125. The top tray portion 152 includes a conical-type or pyramid-type or other type of funnel section 153 for supporting plant pots of different sizes (diameters) and for directing drainage water to a collecting hole 154. An interior pipe 155 within the stand 150 directs the collected water down to a removable, drainage-storing bucket 158. The drainage-storing bucket 158 is placed behind the access door 157 and supported on the base portion 159 of the stand.

An interior frame 165 (which is shown to have an H-shaped in the cross-sectional view) is fastened to the top of the base portion 159 to support the top tray portion 152 and the combined weight of the plant, wet soil and pot (not shown). The pipe 155 passes through the horizontal mid-portion of the H-shaped interior frame 165. The horizontal mid-portion of frame 165 provides structural stability and also prevents the pipe 155 from shaking excessively when a next-described shut-off valve 156 is operated. Although not shown in the cross sectional view of FIG. 2, the interior frame 165 also has horizontal braces at its top and bottom for providing further structural strength and for fixedly fastening the frame 165 respectively to the top tray portion 152 and the base portion 159.

A shut-off valve 156 is provided, preferably at the accessible lower end of the interior pipe 155, for temporarily shutting off the flow of drainage water from the pipe 155 to the drainage-storing bucket 158. When the shut-off valve 156 is in the closed position, the bucket 158 may be emptied without worry that water will drip (or pour) from the pipe 155 and undesirably splash onto the floor 105. Emptied drainage water may be filtered and reused for irrigation if desired.

The drainage-storing bucket 158 is preferably sized to hold as much as approximately one or more gallons of drainage water. It has been found through experience that large pots 120 (those with relatively large amounts of absorbent potting soil 125) tend to drip water continuously for many hours. The total amount of drainage water per 24-hour day can be as much as one or more gallons. The drainage-storing bucket 158 should be sized so that it will not overflow under a predefined regiment of waterings and bucket emptyings.

In one embodiment, the drainage-storing bucket 158 is sufficiently large to store the accumulated drainage water drippings of the potted plant over a continuous 8-hour period, and more preferably over a continuous 12-hour period, and more even preferably over a continuous 24-hour period.

The area in which the drainage-storing bucket 158 sits should be made waterproof as a precaution, so in case there is an overflow or spill, the carpet or other floor 105 below the stand will not be soiled.

The exterior finish 151 decoratively surrounds and hides the interior frame 165, the pipe 155, the shut-off valve 156, the drainage-storing bucket 158, the top of the base portion 159 and the sides of the top tray portion 152. As already indicated above, the exterior finish 151 is selected to match or at least complement the surrounding decor of the room 100.

One advantage of the present invention is that drip drainage of irrigating water 145 can be carried out in unnoticed fashion, continuously throughout the day without need for personal attendance. The drainage-storing bucket 158 should be large enough to accommodate at least one-day's worth of irrigating water 145. At the end of the day (or at any other convenient time), the access door 157 is opened, the shut-off valve 156 is temporarily closed, and the drainage-storing bucket 158 is removed for emptying. Then bucket 158 is replaced under the drainage pipe 155, the shut-off valve 156 is re-opened, and the access door 157 is closed so that drainage may continue in an unobtrusive manner.

Another advantage of the present invention is that amount of irrigating water 145 used per day is not limited by the volume of the drainage storing bucket 158. If large amounts are to be used, as for example when the soil is being flushed clean of undesired chemicals, the shut-off valve 156 can be closed temporarily while the drainage storing bucket 158 is emptied and/or replaced with an empty second bucket. During the interim, the top tray portion 152 and pipe 155 function as temporary stores for the water draining out of the potting soil 125. The process of temporarily closing the shut-off valve 156, emptying/replacing the drainage-storing bucket 158 and reopening the valve 156, may be carried out as many times as necessary to move a desired volume of irrigating water through the soil and root system in a given time period (e.g., in a given day).

As indicated earlier, the access door 157 is finished similarly to the remaining exterior finish 151 of the stand 150 so that the presence of the access door 157 is generally unnoticeable. A magnetic door latch 160 (FIG. 1) may be used to hold the door shut. A conventional door knob 161 (or draw handle) may be provided on the exterior of the access door 157 for opening it. Alternatively, the door latch 160 may be of the unnoticeable, spring-loaded, push-to-open type such as found in household medicine cabinets. The access door 157 may swing on hinges 162 or may slide out from its opening or may provide access to the interior bucket 158 and shut-off valve 156 in other well known fashions (e.g., push-in and slide up).

As further indicated above, the base wheels 159*a*–159*d* are designed to rollably but stably support the weight of the remainder of the stand 150 (including a water-filled bucket 158 and the combination of the pot 120, wet soil 125 and plant 110) on a carpeted or other floor 105 such that the stand 150, with plant 110 and all, can be easily pushed across the floor 105 and/or can be easily rotated about a current position so as to provide uniform lighting and ventilation to the potted plant 110. Accordingly, the stand 150 can be pushed to an open window 108 or to an outdoor patio for fresh air and sunlight when desired, and periodically rotated about its position so as to uniformly light and ventilate the plant 110 for encouraging symmetric growth.

The top-view profile of the stand 150 is preferably symmetric so that the room decor appears substantially unchanged even if the stand is rotated about its vertical axis by an angle less than 360 degrees. The top-view profile can be square-shaped as in the illustration to provided for unnoticeable 90° rotations, or it can have any other symmetry such as for unnoticeable 180° rotations, or unnoticeable 60° rotations (hexagon shaped), and so forth, including circular and elliptical shapes.

Many different kinds of materials may be used to construct the plant stand 150 of FIG. 2, including one or more of natural wood, composite wood, metals such as aluminum and suitable plastics. The construction details for a wood-based embodiment having a square-shaped top view are now provided, but it should be apparent that the invention is not limited to construction from wood and that other shapes and dimensions are contemplated.

The overall height for the wood-based embodiment of stand 150 is H1=approximately 42 inches. The top tray portion 152 has a width dimension of W1=approximately 13.5 inches. The base portion 159 (including wheels 159*a*–159*d*) has an approximate height dimension of H2=3 inches and a width dimension of approximately W2=14 to 16 inches. The middle column portion (165) has a height dimension of approximately H3=36 inches and a width dimension of approximately W3=9 to 10 inches. The top tray portion 152 has a height dimension of approximately H4=3 inches and a side thickness dimension of approximately W4=⅝ inch. The inside width dimension, W1 minus 2 times W4, of the top tray portion 152 is preferably at least 11 inches, and more preferably, roughly 12 inches so that it can easily accommodate an industry-standard, 11 inch wide pot. The tilted funnel section 153 has a tilt height of approximately H5=0.3 inch and a tilt width of approximately W5=5 1/16 inches. Pipe 155 is made of PVC or another appropriate waterproof material. It has a length of approximately 22 inches, an outer diameter of approximately 0.5 inch and is threaded at both ends. The access door/opening 157 has a height dimension of approximately H6=11 inches and is arranged so that shut-off valve 156 is easily seen when the access door is open, and further so that bucket 158 may be easily removed therethrough for emptying.

Construction of one embodiment proceeds as follows. The base portion 159 is made by cutting two square pieces of ¾ inch thick plywood, each 16×16 inches. The two square pieces are glued and nailed together to give the base portion a thickness of approximately 1.5 inches. Recesses are bored symmetrically at the bottom extremes of the base portion 159 and caster wheels 159*a*–159*d* are installed. The caster wheels can be of the 1.5 inch ball type and should be able to both roll and turn with ease under the weight of a fully-loaded plant stand 150.

The interior frame 165 is formed of four pieces of white wood, each 36 inches long. The pieces are assembled to form a rectangular frame of 9×9×36 inches. The four 36 inch pieces may be pre-laminated on their exterior with an appropriate finish 151 so as to define the exterior of the columnar mid portion of the stand.

Three square frame braces are formed of 2×⅝ inch wood to each have end-to-end widths of 7.75 inches. These three brace pieces are respectively glued and nailed to the interior top middle and bottom portions of the frame to hold the frame together. A flat piece of wood having a ¾ inch hole drilled through its center is placed on the middle brace for restraining the 0.5 inch pipe 155 from excessive lateral movement as shown in FIG. 2.

The bottom brace portion of frame 165 is nailed and/or glued to the top of base portion 159. The 22 inch long PVC pipe 155 is passed through the ¾ inch bore at the center of the H-shaped frame 165. A ¼ turn shut-off valve 156 is screwed onto the bottom end of the pipe 155 and the joint is sealed with PVC cement.

The top tray portion 152 is formed with ⅝ inch regular white wood cut and fastened together to form an open-top box having the height dimension H4 and width dimension W1. A ⅝ths inch hole is bored through the center of the tray 152 and the upper end of pipe 155 is threaded through from the bottom of the ⅝th inch bore to extend slightly above the top surface. The top tray portion 152 is then nailed and/or glued to the top of the frame.

The tilted funnel portion 153 is formed of a waterproof material such as epoxy and extends to the open upper end of the PVC pipe 155. In one embodiment, a square piece of plywood, 10¼ inches on each side, is cut into four identical 45° right triangle pieces. Quarter inch round pieces of wood are glued in against the inner corners of the tray and the 45° right triangle pieces are dropped on top in pie-wedged format and glued to the remainder of the tray to form a base for the tilted funnel surface. Then fiberglass cloth and fiberglass cement are added on top to waterproof the surface. The top surface of the fiberglass waterproofing is given a rough finish to prevent slippage of the pot 120 that is to be placed on top of the funnel section 153. The ⅝ths inch bore is extended through the funnel section 153 before pipe 155 is threaded in. Then PVC cement or the like is used to seal the joint of the pipe end to the funnel section 153 and to thereby provide a waterproof path for draining water from the pot, down the tilted slopes of the funnel section 153 and into the PVC pipe 155. Pipe 155 then directs the water into drainage-storing bucket 158. The outer exterior finishing 151 of the stand 150 is completed as appropriate. The finishing 151 is preferably of a waterproof type. Laminated wood panelings may be formed around the frame 165 with a cut out provided for access door 157. The access door may be attached by hinges or other appropriate means. Laminate can also be applied to the top and side surfaces of base portion 159 and outer portions of the top tray portion 152. The finish 151 may alternatively be provided with appropriate wood stain and varnishing techniques or waterproof paints of desired colors and textures. As a further alternative or in addition, various trimmings, plastic panels and/or even fabric coverings may be added to complete the exterior finish 151 according to taste.

The above disclosure is to be taken as illustrative of the invention, not as limiting its scope or spirit. Numerous modifications and variations will become apparent to those skilled in the art after studying the above disclosure.

By way of example, the shut-off valve 156 may be made of an automatic type which automatically shuts off when the drainage storing bucket 158 approaches an overfill condition and/or is removed. An alarm function might be added to indicate an approaching overfill condition. The valve function can be carried by a variety of alternative means including, but not limited to, a removable plug inserted into the end of the pipe 155 for temporarily corking it, or a clamp temporarily placed across an optional, hose-like, clamp-able section of the pipe.

The height versus width ratio of the top tray portion 152 may be made substantially greater than that disclosed above so that the interior of the top tray portion 152 can temporarily store more drainage water after valve 156 is shut off either manually or automatically. The top tray portion 152 may be made so tall that it substantially hides the outer surface of the plant pot 120. This may be useful in cases where the plant pot 120 does not have an attractive finish. The outer surface of the top tray portion 152 is then used for decoratively hiding the unattractive pot 120.

By way of further example of possible variations, the base wheels 159*a*–159*d* may be hidden by a decorative skirt (not shown), provided about the periphery of the base portion 159.

By way of further example, the bottom caster wheels 159*a*–159*d* may be replaced by a bearing system that provides for rotation of the stand independently of moving the stand about the room.

A variety of decorative shapes may be used for the outside of the stand 150 including but not limited to those of: a frusto-conical section, a frusto-pyramid, and an upside-down wine glass shape where the top tray portion (152) is defined by what is normally the base of the wine-glass when right-side up and the pipe passes through the stem of the upside-down wine glass shape.

Given the above disclosure of general concepts and specific embodiments, the scope of protection sought is to be defined by the claims appended hereto.

What is claimed is:

1. An apparatus for supporting a plant/pot combination including a potted plant and its soil and a drainable pot, said plant/pot combination having weight, the support apparatus comprising:

(a) a tray portion adapted for receiving pots of different sizes, said tray portion being further adapted for supporting the combination of the plant, pot and soil from underneath, said tray portion being further adapted for collecting and moving drainage water away from the plant/pot combination;

(b) a drainage storing portion, positioned below the tray portion, for receiving and storing drainage water collected by the tray portion;

(c) a middle portion, positioned between the tray portion and the storing portion, for supporting the tray portion, and the weight of the plant, pot and soil, above the storing portion while allowing collected drainage water to pass therethrough from the tray portion to the storing portion; and (d) decoration means, surrounding the drainage storing portion and the middle portion, for decoratively hiding the drainage storing portion and the middle portion.

2. A support apparatus according to claim 1 further comprising:

(e) directing means, located within the middle portion, for directing a flow of drainage water through the middle portion from the tray portion to the storing portion; and (f) shut-off means, coupled to the directing means, for temporarily shutting off the flow of drainage water to the storing portion.

3. In combination with other room furnishings, a decorative plant stand for supporting a periodically irrigated plant and its soil, said stand comprising:

collecting means for continuously collecting water draining from the plant and soil, storing means, operatively coupled to the collecting means, for storing collected drainage water;

access means for accessing the storing means and enabling the stored drainage water to be emptied from the storing means; and decoration means, covering the collecting means and the storing means and the access means, for decoratively hiding the collecting means and the storing means and the access means, the decoration means complementing said other room furnishings.

4. A combination according to claim 3 wherein at least one of the other room furnishings has a decorative finish of predefined coloring, patterning and texture and wherein said decoration means has one or more of a corresponding coloring, patterning and texture matching that of the at least one other room furnishing.

5. A combination according to claim 3 wherein at least one of the other room furnishings has a decorative finish of a predefined geometric shape and wherein said decoration means has a corresponding geometric shape matching that of the at least one other room furnishing.

6. A combination according to claim 5 wherein the geometric shape of the decoration means has a symmetric top view profile such that the stand appears substantially the same after being rotated about its vertical axis by an angle less than 360°.

7. An apparatus for supporting an irrigatable plant/pot combination where the plant/pot combination has a bottom portion and includes a drainable pot containing soil and a plant rooted in said soil, and where the plant/pot combination has weight and size, said supporting apparatus comprising:

(a) tray means for supporting the weight of the plant/pot combination substantially through the bottom portion of the plant/pot combination;

(b) drainage removal means for receiving irrigation water draining from the plant/pot combination and for transporting the received water away from the plant/pot combination;

(c) drainage storing means for storing the transported irrigation water; and (d) decoration means surrounding the drainage removal means and the drainage storage means for decoratively hiding the drainage removal means and the drainage storing means.

8. A support apparatus according to claim 7 wherein the combination of the plant and soil has a dry weight greater than 10 pounds.

9. A support apparatus according to claim 8 wherein the combination of the plant and soil has a dry weight greater than 30 pounds.

10. A support apparatus according to claim 7 wherein the drainage storing means is sufficiently large to store accumulated drainage water drippings from the combination of the plant and soil at least over a continuous 8-hour drainage period.

11. A support apparatus according to claim 7 wherein the drainage storing means is sufficiently large to store at least one gallon of water.

12. A support apparatus according to claim 7 wherein the tray means includes a funnel section for funneling drainage water from the plant/pot combination into a middle portion of the tray means, said funnel section being further adapted to receive and support pots of different sizes.

13. A support apparatus according to claim 12 wherein the middle portion of the tray means includes directing means, coupled in a sealed manner to the funnel section, for directing funneled drainage water through the middle portion from the funnel section into the drainage removal means.

14. A supporting apparatus according to claim 7 further comprising:

(e) decorative access means for providing access to the drainage storing means so that accumulated water in the drainage storing means can be periodically emptied, said decorative access means being decorated to mesh non-conspicuously with the decoration means.

15. A supporting apparatus according to claim 7, wherein the drainage removal means defines at least part of a transport path for water draining from the plant/pot combination, said supporting apparatus further comprising:

(e) valve means, interposed along the transport path, for selectively shutting off the flow of drainage water to the drainage storing means.

16. A supporting apparatus according to claim 15 wherein said drainage storing means is accessible through an access opening for removing water stored therein and wherein said valve means is positioned proximate to the drainage storing means so as to be operable through the access opening for selectively shutting off the flow of drainage water to the drainage storing means.

17. A supporting apparatus according to claim 15 further comprising:

(f) rotation means for rotating the tray means and thereby providing for rotation of the supported plant/pot combination.

18. A supporting apparatus according to claim 15 wherein the drainage storing means is sufficiently large to store at least one gallon of water.

19. A supporting apparatus according to claim 15 wherein the plant/pot combination has a dry weight greater than 10 pounds.

20. A supporting apparatus according to claim 7 wherein the supporting apparatus is adapted to support a planet/pot combination having a dry weight of at least as much as 30 pounds and an even greater wet weight.

21. A supporting apparatus according to claim 20 wherein the supporting apparatus is adapted to support a plant/pot combination having a dry weight of at least as much as 50 pounds and an even greater wet weight.

22. A supporting apparatus according to claim 7, wherein the tray means has a funnel shaped section for accommodating plant/pot combinations of different sizes.

23. A supporting apparatus according to claim 22, wherein the funnel shaped section is sufficiently large to accommodate pots having effective base diameters of as much as 11 inches.

24. A supporting apparatus according to claim 7, further comprising:

(e) base means for supporting the combined weights of the plant/pot combination, the tray means the drainage removal means, the drainage storing means and the decoration means; and wherein the tray means is positioned to support the plant/pot combination at least approximately 36 inches above the base means.

25. An apparatus for irrigating a plant/soil combination where the plant/soil combination includes soil and a plant rooted in said soil, and where the plant/soil combination has weight and size, said irrigating apparatus comprising:

(a) drainage removal means for collecting irrigation water draining from the plant/soil combination and for transporting the collected water away from the plant/soil combination along a transport path;

(b) flow shut-off means, interposed along the transport path, for selectively shutting off the flow of collected water through the transport path; and (c) decoration means surrounding the drainage removal means for decoratively hiding the drainage removal means.

26. An irrigating apparatus according to claim 25 wherein the decoration means further surrounds the flow shut-off means and decoratively hides the flow shut-off means.

27. An irrigating apparatus according to claim 25 further comprising:

(d) drainage storage means, operatively coupled to the transport path, for receiving and storing drainage water transported through the transport path and through the flow shut-off means;

wherein the decoration means further surrounds the drainage storage means and decoratively hides the drainage storage means.

28. An irrigating apparatus according to claim 27 further comprising:

(e) a waterproof drainage storage supporting base for supporting the drainage storage means.

29. An irrigating apparatus according to claim 25 wherein:

the drainage removal means includes a funnel-shaped tray for both supporting the plant/soil combination and collecting the irrigation water draining from the plant/soil combination; and the decoration means further surrounds the funnel-shaped tray and decoratively hides the funnel-shaped tray.

30. An irrigating apparatus according to claim 29 wherein said funnel-shaped tray is sufficiently large to accommodate pots having base diameters as large as 11 inches.

31. An irrigating apparatus according to claim 29 wherein said funnel-shaped tray is roughly finished so as to prevent slippage of the pot.

32. An apparatus for supporting an irrigatable plant/pot combination having a given dry weight, where the plant/pot combination includes a pot containing soil and a plant rooted in the soil, where the pot has a bottom portion of given width on which said dry weight and additional water weight of the plant/pot combination may rest, and where said supporting apparatus comprises:

(a) a tray for stably supporting, through the bottom portion of the pot, said dry weight and additional water weight of the plant/pot combination, the tray being adapted to stably support pot bottoms of substantially different widths;

(b) a drainage removal mechanism for receiving irrigation water draining from the plant/pot combination and for transporting the received water away from the plant/pot combination;

(c) a support for a drainage storing means, the drainage storing means being for storing the transported irrigation water; and (d) decoration means surrounding the drainage removal mechanism and the support of the drainage storage means, said decoration means being for decoratively hiding the drainage removal mechanism, the support of the drainage storing means and the drainage storing means.

33. An apparatus according to claim 32 wherein the drainage removal mechanism includes a valve for temporarily shutting off the transport of said irrigation water through the drainage removal mechanism, said valve being surrounded by the decoration means.

34. An apparatus according to claim 33 wherein the decoration means includes access means for accessing the valve so as to operate the valve.

35. An apparatus according to claim 32 wherein the tray is spaced at least approximately 36 inches above said support of the drainage storage means.

36. An apparatus according to claim 32 further comprising:

(e) a frame interposed between the tray and the support of the drainage storage mean for supporting the weight of said plant/pot combination.

37. An apparatus according to claim 36 wherein the plant/pot combination has a dry weight greater than 30 pounds.

38. An apparatus according to claim 32 wherein the tray is adapted to stably support pot bottoms having widths at least as large as 11 inches.

* * * * *

UNITED STATES PATENT AND TRADEMARK OFFICE

CERTIFICATE OF CORRECTION

PATENT NO. : 6,385,899 B1
DATED : May 14, 2002
INVENTOR(S) : Mary Sachiko Kawai

It is certified that error appears in the above-identified patent and that said Letters Patent is hereby corrected as shown below:

Title page,
Item [76], "Sachiko Mary Treganza, 5066 Pine Tree Ter., Campbell, CA (US) 95008" should be -- Mary Sachiko Kawai, 3673 Harvard Drive, Oceanside, CA (US) 92056 --.

Signed and Sealed this

First Day of October, 2002

*Attest:*

*Attesting Officer*

JAMES E. ROGAN
*Director of the United States Patent and Trademark Office*